United States Patent [19]

Schuermann et al.

[11] 4,171,924

[45] Oct. 23, 1979

[54] MULTIPARTITE ROCK BOLT

[75] Inventors: Fritz Schuermann, Hattingen; Johannes Neubauer, Essen; Günther Kirz, Alsweiler; Heinz Fuchs, Ruthweiler, all of Fed. Rep. of Germany

[73] Assignees: Bergwerksverband GmbH, Essen; Saarländische Gesellschaft für Grubenausbau und Technik mbH, Ottweiler, both of Fed. Rep. of Germany

[21] Appl. No.: 878,851

[22] Filed: Feb. 17, 1978

[30] Foreign Application Priority Data

Feb. 19, 1977 [DE] Fed. Rep. of Germany ..... 2707304

[51] Int. Cl.[2] ..... E21D 21/00

[52] U.S. Cl. ..... 405/259; 403/340

[58] Field of Search ..... 61/45 B; 403/340, 339, 403/379, 393, 388; 405/259

[56] References Cited

U.S. PATENT DOCUMENTS

| | | | |
|---|---|---|---|
| 317,155 | 5/1885 | Lowrie | 403/339 |
| 336,783 | 2/1886 | Bartholomew | 403/340 |
| 1,272,131 | 7/1918 | Silberg | 403/340 |
| 2,930,199 | 3/1960 | Jarund | 61/45 B |
| 3,216,306 | 11/1965 | Taylor | 61/45 B X |
| 3,987,635 | 10/1976 | Murphy | 61/45 B |
| 4,048,875 | 9/1977 | Heinen et al. | 61/45 B |

FOREIGN PATENT DOCUMENTS

| | | | |
|---|---|---|---|
| 920781 | 11/1954 | Fed. Rep. of Germany | 61/45 B |

*Primary Examiner*—Mervin Stein

*Attorney, Agent, or Firm*—Michael J. Striker

[57] ABSTRACT

A multipartite rock bolt includes a plurality of individual discrete elements which are connected to each other at their respective end portions to constitute the rock bolt which is anchored, especially cemented, in a hole of the rock to be consolidated by the rock bolt. The end portions of the elements have complementary recesses therein at which the respective assembled elements overlap each other and the connecting arrangement for connecting the respective end portions includes a projection, particularly a pin which extends transversely of the elongation of the element into the recess and is received in a complementary aperture, particularly a hole, provided at the recess of the other element. The recess is partially bounded by a detaining surface extending substantially longitudinally of the element, and the detaining surface may be inclined relative to the elongation of the element.

16 Claims, 11 Drawing Figures

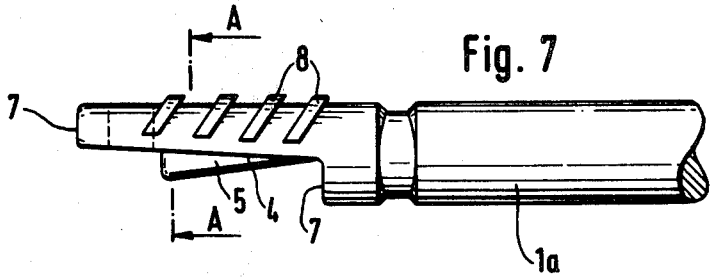
Fig. 7
Fig. 8
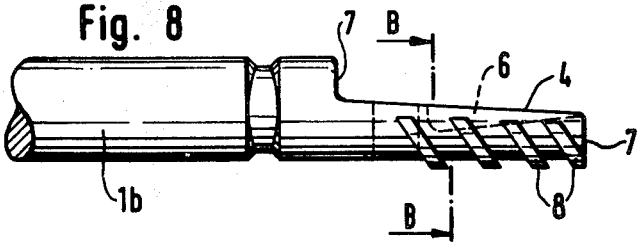
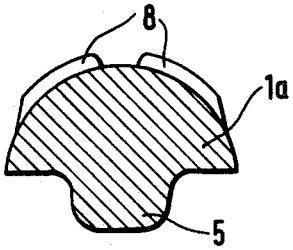
Fig. 9
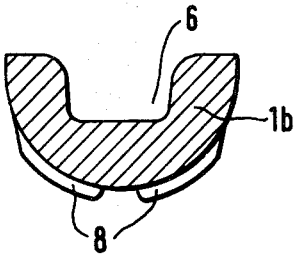
Fig. 10

MULTIPARTITE ROCK BOLT

BACKGROUND OF THE INVENTION

The present invention relates to a multipartite rock bolt to be used for consolidating rocks in general, and more particularly to a rock bolt for use in floor rock of underground excavations, particularly mines.

It is well known that, particularly in underground excavations, but also under different circumstances, a rock formation may have a tendency to disintegrate at a location where it is desired that it remain intact. So, for instance, in an underground mine, the mine floor, to give an example, may become unstable due to the pressure acting on the floor rock from the surrounding strata and, if unchecked, the floor rock would develop cracks and possibly move upwardly, thus creating problems and possibly hazardous conditions in the mine. This, of course, is very disadvantageous.

When it was in the past desired to consolidate rocks, that is, to prevent their undesired disintegration, resort has been had, in one of the conventional approaches, to the use of one-piece rock bolts usually made of steel which are introduced into and anchored, especially cemented, in respective holes drilled or otherwise provided in the rock formation to be prevented from disintegration. While these conventional one-piece rock bolts may be very advantageous in many applications, the possibilities of their use in underground excavations, particularly mines, are quite limited. More particularly, experience has shown that, for instance, if floor rock of an underground mine is to be consolidated, the desired or even necessary length of the rock bolt which is needed for reliably consolidating the floor rock, in most instances, is greater than the available height of the drift, adit, mining gallery or the like wherein the rock bolt is to be used for consolidating the floor rock. A further disadvantage of this prior-art approach is that, even if the one-piece rock bolts were originally long enough to be able to hold the floor rock in place, they do not give an assurance that the floor rock which is consolidated or stabilized in this manner will also withstand the subsequent enlargement of the mining gallery or the like. Thus, when this method is resorted to, it must be borne in mind that the floor rock which is secured in this manner is likely to break up and rise only at a later time than an unsecured floor rock, but that the process, more likely than not, will not be avoided altogether. In addition thereto, the steel rock bolts considerably hinder the subsequent removal of remaining coal from the floor of the underground mine by suitable machinery, such as lowerable loaders or the like. Thus, only a partial success has been achieved in stabilizing the floors of underground excavations, particularly mines, by resorting to the use of the one-piece anchor bolts, particularly inasmuch as the length of the one-piece elongated rock bolts is in most instances, as established by experience, insufficient.

In addition to the use of one-piece steel rock bolts, there has also already been proposed a different approach which resides in the use of two-piece rock bolts which incorporate separate elements which are connected to one another by means of external sleeves. Even this arrangement, however, is disadvantageous in some respects, particularly in view of the substantial cost of this combined arrangement, particularly the manufacturing cost of the connecting sleeves. Furthermore, the establishing of the connection between the individual elements is rather cumbersome. Another disadvantage of this approach is encountered when the rock bolt is to be cemented in the associated hole by a cementing material which is accommodated in cartridges which are to be penetrated by the rock bolt during the introduction thereof into the respective anchoring hole. Under these circumstances, the external sleeves connecting the individual elements of the rock bolt constitute a formidable hindrance to the introduction of the rock bolt into the associated anchoring hole.

SUMMARY OF THE INVENTION

Accordingly, it is a general object of the present invention to avoid the disadvantages of the prior art.

More particularly, it is an object of the present invention to provide a multipartite rock bolt which is not possessed of the disadvantages of the prior-art rock bolts.

A further object of the present invention is to provide a rock bolt which is especially suited for use in consolidating the rock present at the floor of an underground excavation, particularly a mine, which has a tendency to rise.

A yet another object of the present invention is to so construct the rock bolt as to be assemblable to any desired length.

A further and additional object of the present invention is to design a rock bolt which can be assembled from individual elements outside of the anchoring hole while remaining stable within the anchoring hole.

A concomitant object of the present invention is to provide a rock bolt which is simple in construction, inexpensive to manufacture and use, and reliable nevertheless.

Finally, it is an enumerated object of the present invention to develop a rock bolt which is capable of being driven in rotation at least during the introduction thereof into the associated anchoring hole.

In pursuance of these objects and others which will become apparent hereafter, one feature of the present invention resides, briefly stated, in a multipartite rock bolt of the type which is to be accommodated and anchored, especially cemented, in an elongated hole in rock, particularly in floor rock of an underground excavation, to consolidate the rock, which rock bolt comprises a plurality of discrete elongated elements each of which has longitudinally spaced end portions and which are so assemblable with one another into the rock bolt that the respective of said end portions of said elements register with one another in the assembled rock bolt; and interengageable means for connecting said respective registering end portions of said elements to one another and for transmitting torsional, tensile and compressive forces between said elements in the assembled rock bolt, the connecting means being so located on said end portions of said elements as to be fully within the boundaries of the assembled rock bolt. It is particularly advantageous when the connecting means is so configurated as to be permanently engaged when the assembled rock bolt is confined within the elongated hole in the rock.

Within the framework of the present invention, it is particularly advantageous when the connecting means includes means bounding complementary recesses in the respective registering end portions which open radially of the elements, a projection on one of the respective registering end portions and extending into the recess thereof, and means forming an aperture in the other of the respective registering end portions for receiving the projection in the assembled rock bolt. Then, it is particularly advantageous when the bounding means includes at least one wedge surface which is inclined with respect to the elongation of the respective element and a bottom surface extending from said wedge surface at an angle thereto toward the circumference of the respective end portion. Then, each of the respective registering end portions may advantageously have a longitudinal end face which contacts the bottom surface of the other of the respective registering portions in the assembled rock bolt, the wedge surface being advantageously so inclined that the recess converges toward the longitudinal end face of the respective end portion. In this connection, it is particularly advantageous when the projection and the aperture extends substantially normal to the elongation of the respective element.

In the alternative, the wedge surface may be so inclined that the recess diverges toward the longitudinal end face of the respective end portion. Then, the projection advantageously is configurated as a ridge and the aperture is complementarily configurated as a depression. Preferably, both the ridge and the depression extend substantially longitudinally of the respective element. Then, it is particularly advantageous when the ridge and the depression have respective contact surfaces which extend inclinedly relative to the elongation of the respective element.

The longitudinal end face and the bottom surface of the respective registering end portions may be planar; however, it is also contemplated by the present invention for these surfaces to be complementarily rounded. It is also very advantageous, as proposed by the present invention, to provide the bottom surface and the longitudinal end face with respective rounded portions which gradually merge into the above-mentioned wedge surface.

According to a further concept of the present invention, the above-mentioned bounding means includes at least two detaining surfaces which extend substantially longitudinally of the respective element and which are offset relative to each other transversely of the respective element, and at least two bottom surfaces each extending from one of the above-mentioned detaining surfaces substantially transversely of the respective element. In this connection, it is particularly advantageous when the connecting means further includes an additional projection and an additional means forming an additional aperture, the projections and the apertures being so arranged at the respective ones of the detaining surfaces that the projections are received in the apertures in the assembled rock bolt. Then, it is especially preferred that each respective end portion have one of the projections arranged at one of the detaining surfaces and one of the apertures arranged at the other of the detaining surfaces. Advantageously, at least one of the detaining surfaces is inclined relative to the elongation of the respective element.

As further proposed by the present invention, the above-mentioned detaining surfaces are angularly offset from one another circumferentially of the respective end portion. However, whether one or two of the detaining surfaces are provided at each of the end portions of each of the elements of the rock bolt, the detaining surfaces present at the opposite ends of the same element may be angularly displaced relative to each other circumferentially of the element.

As also proposed by the present invention, the plurality of elements may include a leading element which is to be introduced into the hole in the rock first, the leading element having at least one inclined surface at the end thereof which is remote from the connecting means. Preferably, the inclined surface extends over the entire cross section of the leading element. Furthermore, the plurality of elements may include a trailing element which is to be introduced into the hole in the rock last; then, the trailing element is advantageously made of a relatively easily destructible material, such as wood.

The advantages obtained by resorting to the present invention are to be mainly seen in the fact that the multipartite assemblable rock bolt of the present invention presents a practical and inexpensive solution which avoids the previously existing problems which have arisen during the introduction of the conventional rock bolts into associated anchoring holes, the present invention rendering it possible to achieve the desired anchoring values which are needed for stabilizing or consolidating the floor rock, especially of underground mines, which has a tendency to rise due to the pressure of the surrounding strata thereon.

A particularly advantageous embodiment of the present invention is obtained when each of the elements has a plurality of individual projections which extend to a small extent beyond the circumference of the element at least at one of the end portions thereof. Such individual projections may have polygonal outlines, such as square, rectangular or trapezoidal outlines. However, it is also possible to make these individual projections round, such as circular or oval, or to give them any desired, even irregular configurations.

Moreover, in accordance with a further aspect of the present invention, the above-mentioned element may be peripherally corrugated at least at one of the end portions thereof. So, for instance, the element may comprise at least one peripheral ridge which constitutes the peripheral corrugation of the element, but preferably two such ridges which are spaced from one another. Then, it is particularly advantageous when the peripheral ridge, or each of the peripheral ridges, extends substantially circumferentially of the element to at least partially surround the same, especially along a helical course.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a somewhat diagrammatic illustration of the rock bolt of the present invention as anchored in an anchoring hole in the floor of an underground mine or the like;

FIG. 7 is a view similar to FIG. 3 but illustrating a further modification of the configuration of the end portion of one of the elements to be joined;

FIG. 8 is a view similar to FIG. 7 but illustrating the configuration of the end portion of the other of the elements to be joined;

FIG. 9 is a sectional view taken on line A—A of FIG. 7; and

FIG. 10 is a cross-sectional view taken on line B—B of FIG. 8.

DETAILED DISCUSSION OF THE PREFERRED EMBODIMENTS

Figure 1:
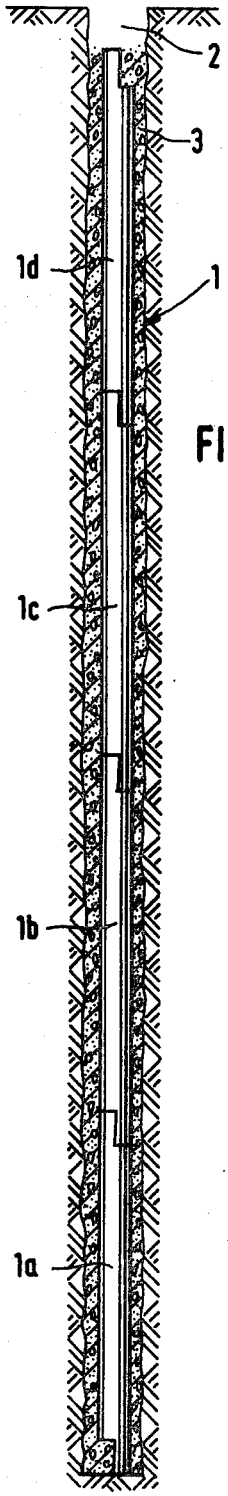

Referring now to the drawing in detail, and first to FIG. 1 thereof, it may be seen that it illustrates a multipartite rock bolt 1 which is already accommodated and cemented in an anchoring hole provided in the rock to be secured against disintegration or shifting. It may be seen that the rock bolt 1, as illustrated, consists of four sections or elements 1*a*, 1*b*, 1*c* and 1*d* and is retained in an anchoring hole 2 over its entire length by means of a cementing body 3. The cementing body 3 may consist of synthetic plastic resin or of a concrete-containing mortar. In any event, the cementing body 3 rigidly connects the rock bolt 1 to the surrounding rock. As illustrated in FIG. 1, the individual elements 1*a*, 1*b*, 1*c* and 1*d* are of completely identical configurations.

Figure 2:
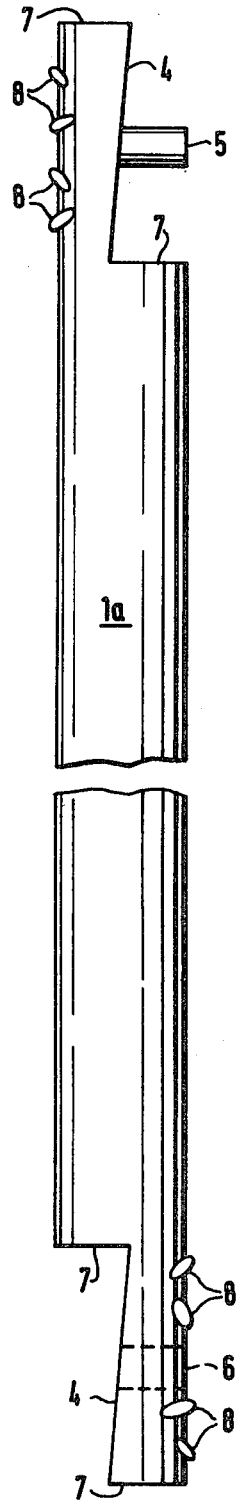
FIG. 2 is a partially sectioned side elevational view of one of the elements which together constitute the rock bolt of FIG. 1.

FIG. 2 illustrates one of the elements, designated as 1*a*, at an enlarged scale to show details thereof. However, it will be appreciated that the expedients and construction which will be presently discussed in connection with the section 1*a* will also be present in most, if not all, of the elements 1*b*, 1*c*, 1*d*, unless otherwise indicated. Thus, the section or element 1*a* has a recess which opens circumferentially of the element 1*a* at each of the end portions thereof. Each of the recesses is partially bounded by wedge surface 4 which is inclined with respect to the elongation of the element 1*a* in such a manner that the width of the recess decreases toward the end face of the respective end portion. A pin or a similar projection 5 extends from the upper wedge surface 4 as illustrated in the drawing, the pin 5 extending substantially normal to the elongation of the element 1*a*. On the other hand, the lower end portion, as illustrated in the drawing, of the element 1*a* is formed with a bore or a similar aperture 6 which opens onto the lower wedge surface 4 and which is so arranged as to complementarily receive and cooperate with the pin 5 of a different element, such as 1*b*. The engagement of the wedge surfaces 4 of the cooperating end portions of the elements 1*a* to 1*d*, as well as the accommodation of the pin 5 in the respective bore 6, render it possible to so couple the elements 1*a* to 1*d* that they can be introduced into the anchoring hole 2 even if rotation is imparted to the rock bolt in any direction about the longitudinal axis thereof. This is rendered possible by the fact that the torsion forces which have to be transmitted between the sections 1*a* to 1*d* and which are necessary for introducing the rock bolt 1 into the anchoring hole 2, are transmitted between the sections 1*a* to 1*d* via the pin 5 and the wedge surfaces 4, while the compressive forces acting on the elements 1*a* to 1*d* are transmitted between the elements 1*a* to 1*d* via respective surfaces 7 which are constituted by the bottom surfaces of the respective recesses, and by the longitudinal end faces of the affected end portions of the elements 1*a* to 1*d*.

A disassembly of the sections 1*a* to 1*d* is only possible outside the anchoring hole 2. As soon as the juncture of the respective elements 1*a* to 1*d* is introduced into the anchoring hole 2, it is no longer possible for the connected elements 1*a* to 1*d* to dissociate at their respective junctures, particularly in view of the very small clearance which exists between the surface bounding the anchoring hole 2 and the rock bolt 1. In this manner, a plurality of the elements 1*a*, 1*b*, 1*c*, 1*d* and so on can be coupled consecutive with one another and introduced into the anchoring hole 2 up to the desired depth.

After the synthetic plastic resin or concrete mortar, which fills the clearance between the surface bounding the anchoring hole 2 and the mutually coupled sections 1*a*, 1*b*, 1*c* and 1*d*, and now integral rock bolt 1 can be subjected to full load in terms of pressure and shearing.

However, the rock bolt 1 can also withstand substantial tensile forces, particularly in view of the fact that the periphery of the respective elements 1*a* to 1*d* is provided with rib-shaped projections 8 at the region of the respective juncture. Now, when the external forces acting on the rock bolt 1 are so oriented as to tend to elongate the rock bolt 1, the presence and mutual engagement of the wedge surfaces 4 results in a situation where the elements 1*a* to 1*d* are slightly spread apart at their respective junctures and exert a spreading force on the synthetic plastic resin or concrete mortar body 3. As a result of this situation, the overlapping region between the elements 1*a* to 1*d* is capable of transmitting approximately the same tensile forces between the elements 1*a* to 1*d* as a sleeve threadedly connected to the sections or elements 1*a*, 1*b*, 1*c* and/or 1*d* at the exterior thereof would, if used. This is attributable to the fact that the synthetic plastic resin or concrete mortar body 3, which engages the surface bounding the anchoring hole 2, possesses, when subjected to the wedging effect of the wedge surfaces 4, a resistance which corresponds to that of an exterior sleeve.

While FIGS. 1 and 2 illustrate the wedge surfaces 4 as being in alignment with one another, it is also contemplated by the present invention to circumferentially offset the wedge surfaces 4 of the respective element 1*a* relative to one another. Such an offsetting may even improve the behavior of the rock bolt 1, particularly its resistance to extraction from the anchoring hole 2. What is important for the present invention, though, is that the two consecutive sections or elements, for instance, 1*a* and 1*b*, be capable of being so coupled as to together form a straight rock bolt 1 or a straight portion thereof.

Figure 3:
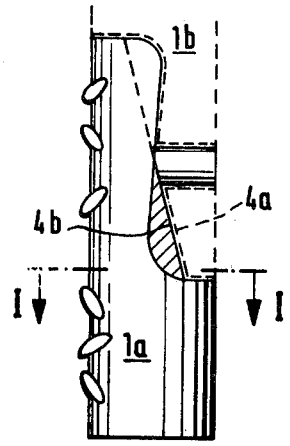
FIG. 3 is also a partially sectioned view which illustrates the connection of two of the individual elements of the rock bolt of the present invention.
Figure 3A:
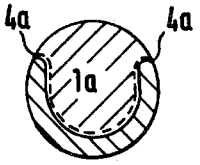
FIG. 3*a* is a section taken on line I—I of FIG. 3.

FIG. 3 illustrates a modification of the basic concept of the present invention, which is in many respects similar to that discussed above so that the same reference numerals have been utilized to identify the corresponding parts. In this modification, two detaining surfaces 4*a* and 4*b* are being used instead of the single wedge surface 4 at each of the end portions of the element 1*a*, these detaining surfaces 4*a* and 4*b* also being inclined relative to the elongation of the element 1*a*. These detaining surfaces 4*a* and 4*b* are rounded at the bottom of the respective recess, which has a particular advantage that the force-transmitting cross section in the overlapping region of two rock bolt elements 1*a*, 1*b* is reduced to a lesser extent than previously. The wedging effect of the detaining surfaces 4*a* and 4*b* is further improved when the respective end portions are configurated as illustrated in cross section in FIG. 3*a*. This Figure is, by-and-large, self-explanatory so that it is merely to be stated that one of the end portions of the elements 1*a*, 1*b* partially surrounds an offset end portion of the other element 1*b*, 1*a*.

Figure 4:
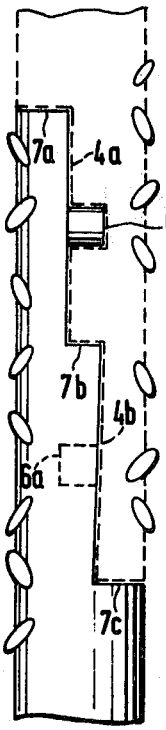
FIG. 4 is a view similar to FIG. 3 of a modification having several detaining surfaces.

A further modification of the basic concept of the present invention as to the configuration of the detaining or wedge surface 4 is illustrated in FIG. 4. Here again, the same reference numerals have been used to designate corresponding parts. In this modification, the respective detaining surface 4 is subdivided in at least two separate detaining surfaces 4*a* and 4*b* so that a saw-tooth-shaped configuration is obtained. Alternatively, a pin 5*a* is provided at one of the detaining surfaces, here 4*a*, and a bore 6*a* is formed at the other detaining surface, here 4*b*. The compression-transmitting surface 7 is subdivided into a plurality of transverse surfaces 7*a*, 7*b*, 7*c*.

Figure 5:
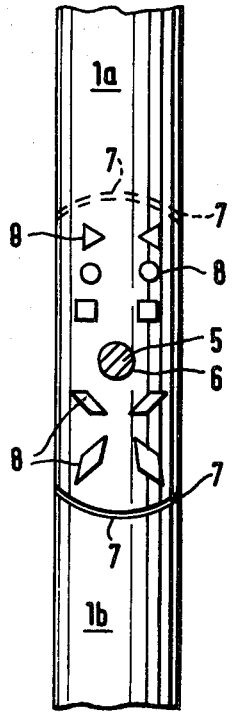
FIG. 5 is a front view of a juncture of two of the elements of the present invention in which the exterior of the end portions has corrugations thereon.

FIG. 5 illustrates, in a front view, a juncture of the elements 1*a* and 1*b* and shows how the pin 5 is accommodated in the bore 6. Furthermore, this figure also illustrates that the compression-transmitting surfaces 7 can be rounded in a complementary manner. Furthermore, FIG. 5 illustrates how the element 1*a* can be provided with a plurality of external projections 8 at least at its region of juncture with the element 1*b*, the projections 8 having the form of ribs. Various possibilities of shaping the projections are illustrated. So, for instance, the projections 8 may be triangular, circular, square, rectangular, trapezoidal, but it is also to be understood that other configurations, including irregular configurations, are also contemplated by the present invention even though not specifically illustrated.

On the other hand, as particularly illustrated in FIGS. 7 to 10, the periphery of at least the region of juncture of the elements 1*a* to 1*d* may be corrugated by the projections 8 which, in these figures, are configurated as ridges which partially surround the circumference of the respective end portion. One or more of these ridges 8 may be provided, and they may be spaced from one another at regular or irregular intervals in the latter instance.

Practical experience has shown that an especially advantageous method of obtaining these elements 1*a* to 1*d* in the desired configurations is a shaping method, and particularly hammering or forging the elements 1*a* to 1*d* in corresponding dies. A particular advantage of this method is that simultaneously the end portions of the sections 1*a* to 1*d* are improved as to their mechanical properties.

Figure 6:
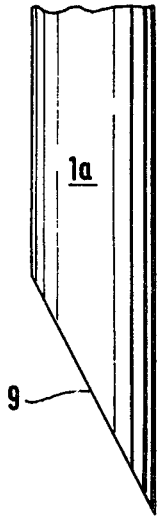
FIG. 6 is a side elevational view of a fragment of a leading element of the rock bolt.

FIG. 6 illustrates a part of the element 1*a* which is to be used as the leading element of the rock bolt 1, at least under some circumstances. This leading element 1*a* of the rock bolt 1 is formed, instead of the above-discussed wedge or detaining surfaces 4, with an inclined end surface 9 which extends over the entire cross section of the element 1*a* at the leading end thereof.

Turning now to FIG. 7, it may be seen therein that the section 1*a* illustrated therein has a recess which increases in width toward the end face 7 and which is partially bounded by the wedge surface 4. Here again, a bottom surface, which also constitutes a compression-transmitting surface and thus has also been designated with the reference numeral 7, like the end face 7, also partially bounds the recess at the bottom thereof, extending transversely of the elongation of the element 1*a*, from the wedge surface 4. The projection 5 this time has a configuration of a wedge-shaped ridge which extends in the longitudinal direction of the element 1*a*, the projection 5 having another wedge surface the distance of which from the longitudinal axis of the section 1*a* increases with a decreasing distance from the end face 7. On the other hand, FIG. 8 illustrates the cooperating end portion of the section or element 1*b* which is assembled in a registering position with the end portion of the section or element 1*a* in the assembled rock bolt 1. This end portion illustrated in FIG. 8 also has a recess which is partially bounded by the wedge surface 4, this recess also increasing in width toward end face 7. However, the aperture 6 which is to receive the projection 5 has the shape of a depression which is also elongated and inclined at its bottom in the longitudinal direction of the section or element 1*b*. Even in this modification, the provision and cooperation of the wedge surfaces 4 and of the complementary parts 5 and 6 render it possible to so couple the sections 1*a* and 1*b* with one another that they can be introduced into the anchoring hole 2 of FIG. 1 while the rock bolt 1 consisting of these sections 1*a* and 1*b* and possibly other correspondingly configurated sections 1*c*, 1*d* and so on, can be rotated about the longitudinal axis of the rock bolt 1 in any direction. Here, the forces which are to be transmitted between the sections 1*a*, 1*b* and which are necessary for driving the rock bolt 1 into the anchoring hole 2, are transmitted via the projection 5 and the depression 6 as to the torsional forces, while the compression forces are transmitted via the compression-transmitting surfaces 7. Even in this modification, it is only possible to disassemble the sections or elements 1*a* and 1*b* outside the anchoring hole 2. As soon as the connection or juncture of these elements 1*a* and 1*b* is introduced into the anchoring hole 2, the only small clearance between the surface bounding the anchoring hole 2 and the rock bolt 1 render any dissociation of the elements 1*a* and 1*b* at their juncture impossible. In this manner, similarly to the above-discussed modifications, an arbitrarily high number of sections 1*a*, 1*b* and so on can be coupled consecutively with one another and introduced into the anchoring hole 2 to any desired extent or depth.

It is further contemplated by the present invention to provide the rock bolt 1 with a profiled or corrugated outer surface instead of the illustrated smooth or cylindrical surface, especially when it is desired to increase the retention value of the rock bolt 1 in the body 3 of synthetic plastic resin or concrete mortar.

The multipartite rock bolt 1 can be introduced into the anchoring hole by resorting to the use of a setting instrument which embraces or accommodates the trailing end of the last of the sections 1*a* to 1*d*, which instrument renders it possible to introduce the rock bolt 1 to such a depth in the anchoring hole 2 that the trailing end of the rock bolt 1 is offset into the rock from the original exposed surface thereof so that, even when the previously mentioned machinery is used for removing material from the floor of the underground excavation or mine, the trailing end of the respective rock bolt 1 will not project into the path of operation of the machinery. However, it is also possible and contemplated by the present invention to make the trailing section or element 1*a* of the multipartite rock bolt 1 of a different material than steel such as, for instance, hardwood or a body incorporating glass fibers which, if necessary, can be easily cut off by the above-mentioned machinery during the operation thereof.

In this manner, the rock bolt 1 is especially suited, for instance, for an early consolidation of the rock when mining galleries or the like having a small cross section are to be later expanded to greater cross sections.

It is immaterial for the use of the multipartite rock bolt 1 which material is being used for cementing the rock bolt 1 in the anchoring hole 2 and in which manner this cementing material is introduced into the respective anchoring hole 2 to form the body 3 therein. However, it is particularly advantageous when resort is being had to the use of cementing cartridges containing polyester resin or epoxy resin, particularly inasmuch as these cementing materials can be used even if the respective anchoring hole 2 is wet. Furthermore, the use of these materials and particularly of these cartridges is also very economical. When the floor rock is dry, cartridges or capsules containing polyurethane can also be used. The use of cartridges of this type is especially advantageous when the application of the rock bolt is to closely follow the opening of the particular underground passage or gallery, that is, prior to any substantial loosening of the support ring. Furthermore, there may arise situations in which the floor which is already rising or which has even already risen must be consolidated. Under these circumstances, it may be useful to first consolidate the rock in the region where the anchoring hole or anchoring holes are provided by injecting synthetic plastic resin or cement glue into the rock and to introduce the rock bolt 1 into the respective anchoring hole 2 immediately thereafter, so as to add the effect of these two measures.

It will be understood that each of the elements described above, or two or more together, may also find a useful application in other types of constructions differing from the types described above.

While the invention has been illustrated and described as embodied in a rock bolt for use for consolidating the floor rock of an underground mine, it is not intended to be limited to the details shown, since various modifications and structural changes may be made without departing in any way from the spirit of the present invention. So, for instance, the rock bolt 1 can also be used, in an underground mine, for consolidating the roof or even the vertical walls bounding an underground passage, or in similar applications. Usually, such additional consolidation will be attended to after a plurality of the rock bolts 1 has already accomplished their purpose of consolidating the floor rock of the underground excavation so that now it is only the roof and/or vertical walls bounding the underground excavation which are either in danger of, or are already, suffering substantial deformations due to the pressure acting thereon from the surrounding rock, which calls for the use of additional rock bolts 1. Also, while it has already been mentioned that the detaining surfaces 4 present at the longitudinally spaced end portion of the element 1*a* may be circumferentially offset with respect to one another, it is also contemplated by the present invention, in the event that two different detaining surfaces 4*a*, 4*b* are provided at each of the end portions, to circumferentially offset these surfaces 4*a* and 4*b* relative to one another.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A multipartite rock bolt of the type which is to be accommodated and anchored, especially cemented, in an elongated hole in rock, particularly in floor rock of an underground excavation, to consolidate the rock, comprising a plurality of discrete elongated elements each of which has longitudinally spaced end portions and which are so assemblable with one another into the rock bolt that mating surfaces on the respective end portions of said elements are juxtaposed and register with one another in the assembled rock bolt; first means on at least one of said end portions of said elements for engaging the surrounding material and for counteracting at least the forces acting lengthwise upon the respective elements; and means located on said juxtaposed registering surfaces of said end portions and disposed wholly within the outer peripheral outlines of said elements, for connecting said elements to one another in the assembled rock bolt and for preventing any longitudinal and rotational movement of said elements relative to one another when the assembled rock bolt is confined within the elongated hole in the rock.

2. A rock bolt as defined in claim 1, wherein said connecting means includes means bounding complementary recesses in said respective registering end portions which open radially of said elements, a projection on one of said respective registering end portions and extending into said recess thereof, and means forming an aperture in the other of said respective registering end portions for receiving said projection in the assembled rock bolt.

3. A rock bolt as defined in claim 2, wherein said bounding means includes at least one wedge surface which is inclined with respect to the elongation of the respective element and a bottom surface extending from said wedge surface and at an angle thereto toward the circumference of the respective end portion; and wherein each of said respective registering end portions has a longitudinal end face which contacts said bottom surface of the other of said respective registering end portions of the assembled rock bolt.

4. A rock bolt as defined in claim 3, wherein said wedge surface is so inclined that said recess converges toward said longitudinal end face of the respective end portion.

5. A rock bolt as defined in claim 4, wherein said projection and said aperture extend substantially normal to the elongation of the respective element.

6. A rock bolt as defined in claim 3, wherein said wedge surface is so inclined that said recess diverges toward said longitudinal end face of the respective end portion.

7. A rock bolt as defined in claim 3, wherein said longitudinal end face and said bottom surface of said respective registering end portions are complementarily rounded.

8. A rock bolt as defined in claim 2, wherein said bounding means includes at least two detaining surfaces which extend substantially longitudinally of the respective element and which are offset relative to each other transversely of the respective element, and at least two bottom surfaces each extending from one of said detaining surfaces substantially transversely of the respective element.

9. A rock bolt as defined in claim 2, wherein said bounding means includes at least one detaining surface which extends substantially longitudinally of the respective element and at least one bottom surface which extends from said detaining surface substantially transversely of the respective element; and wherein the detaining surfaces present at the opposite ends of the same element are angularly displaced relative to each other circumferentially of said element.

10. A rock bolt as defined in claim 1; and further including a plurality of individual projections extending to a small extent beyond the circumference of said element at least at one of said end portions thereof.

11. A rock bolt as defined in claim 10, wherein said individual projections have polygonal outlines.

12. A rock bolt as defined in claim 10, wherein said individual projections have rounded outlines.

13. A rock bolt as defined in claim 1, wherein said first means comprise at least one peripheral ridge which constitutes a peripheral corrugation of the respective element.

14. A rock bolt as defined in claim 13; and further comprising at least one additional peripheral ridge which is spaced from said ridge and also constitutes the peripheral corrugation of said element.

15. A rock bolt as defined in claim 13, wherein said peripheral ridge extends substantially circumferentially of said element to at least partially surround the same.

16. A rock bolt as defined in claim 15, wherein said peripheral ridge extends along a helical course.

* * * * *